US008491011B2

(12) United States Patent
Valaas

(10) Patent No.: US 8,491,011 B2
(45) Date of Patent: Jul. 23, 2013

(54) DEVICE FOR HOLDING A PAIR OF SKIS TOGETHER

(76) Inventor: Laura Aubrey Valaas, Wenatchee, WA (US)

( * ) Notice: Subject to any disclaimer, the term of this patent is extended or adjusted under 35 U.S.C. 154(b) by 229 days.

(21) Appl. No.: 12/930,889

(22) Filed: Jan. 19, 2011

(65) Prior Publication Data

US 2012/0181782 A1 Jul. 19, 2012

(51) Int. Cl.
*A63C 11/02* (2006.01)

(52) U.S. Cl.
USPC ..... 280/814; 294/149; 294/147; 294/163

(58) Field of Classification Search
USPC ..... 280/814; 294/137, 145–148, 159, 294/162–163, 165–166, 160, 170; 206/315.2, 206/315.11, 443; 224/916, 917, 922
See application file for complete search history.

(56) References Cited

U.S. PATENT DOCUMENTS

| | | | |
|---|---|---|---|
| 2,603,393 | A | 7/1952 | Oblusteel |
| 2,963,165 | A | 12/1960 | Steiner |
| 3,301,369 | A | 1/1967 | Karn, Jr. |
| 3,370,766 | A | 2/1968 | Woolworth |
| 3,425,567 | A | 2/1969 | Murray |
| 3,497,891 | A | 3/1970 | Voster et al. |
| 3,570,681 | A | 3/1971 | Kinshofer |
| 3,600,734 | A | 8/1971 | Pollinger |
| 3,608,795 | A | 9/1971 | Klein et al. |
| 3,653,565 | A | 4/1972 | McAusland |
| 3,721,373 | A | 3/1973 | Penniman |
| 3,722,652 | A | 3/1973 | Busch et al. |
| 3,731,348 | A | 5/1973 | Luchne |
| 3,775,794 | A | 12/1973 | Fisher |
| 3,794,226 | A | 2/1974 | Penniman |
| 3,826,022 | A | 7/1974 | Grzech |
| 3,826,378 | A | 7/1974 | Novak |
| 3,841,648 | A | 10/1974 | Meyer |
| 3,965,586 | A | 6/1976 | Roosli |
| 3,999,773 | A | 12/1976 | Shuttleworth |
| 4,000,909 | A | 1/1977 | Coale |

(Continued)

FOREIGN PATENT DOCUMENTS

WO WO 2012/008988 1/2012

OTHER PUBLICATIONS http://www.salomon.com/us/#/nordic/boots Retrieved from the Internet Aug. 3, 2010.

(Continued)

*Primary Examiner* — John Walters
*Assistant Examiner* — James Triggs

(57) ABSTRACT

A one-piece device for keeping a pair of skis together includes: (a) two opposite outer longitudinal side walls, each including a substantially straight central section; (b) two opposite, substantially straight end walls, an end of each end wall being connected with a corresponding end of one of the longitudinal side walls; (c) an inner longitudinal wall between the outer longitudinal side walls, which is attached at its opposite ends to the opposite end walls, and which includes a substantially straight central section; (d) preferably at least one convolution in each of the outer longitudinal side walls, and at least one convolution in the inner longitudinal wall; and (e) the inner longitudinal wall dividing an interior of the ski holder device into two substantially equal sized, ski-receiving, open-ended channels. This simplified abstract is not intended to limit, and should not be interpreted as limiting, the scope of the claims.

20 Claims, 6 Drawing Sheets

U.S. PATENT DOCUMENTS

| | | | | |
|---|---|---|---|---|
| 4,033,460 | A | | 7/1977 | Alexandre |
| D245,892 | S | | 9/1977 | Yocum |
| 4,047,726 | A | | 9/1977 | Kokeisl |
| 4,055,005 | A | | 10/1977 | Meinhart |
| 4,062,453 | A | | 12/1977 | Gorlach |
| D247,415 | S | | 3/1978 | Harper |
| 4,084,867 | A | | 4/1978 | Putt et al. |
| 4,126,255 | A | | 11/1978 | Olson |
| 4,129,312 | A | | 12/1978 | Loffelholz |
| 4,145,062 | A | | 3/1979 | Stiemert |
| 4,145,063 | A | | 3/1979 | Knapp et al. |
| 4,160,301 | A | | 7/1979 | Woolley |
| 4,173,811 | A | | 11/1979 | Kokeisl |
| 4,221,024 | A | | 9/1980 | Becker |
| 4,222,490 | A | | 9/1980 | Wood, Jr. |
| D257,523 | S | | 11/1980 | Allsop |
| 4,244,498 | A | | 1/1981 | Copp |
| 4,248,365 | A | | 2/1981 | Jacobs |
| 4,268,050 | A | | 5/1981 | Kennedy, Sr. |
| 4,479,674 | A | * | 10/1984 | Nordmeyer ..... 294/147 |
| 4,508,229 | A | | 4/1985 | Yost, Jr. |
| 4,530,168 | A | | 7/1985 | Petre |
| 4,531,644 | A | | 7/1985 | Margulies |
| 4,537,436 | A | | 8/1985 | Pfortmiller |
| 4,624,496 | A | | 11/1986 | Bengtson |
| 4,629,103 | A | | 12/1986 | Miller |
| 4,635,800 | A | | 1/1987 | Stempin |
| 4,678,087 | A | | 7/1987 | York |
| 4,696,504 | A | | 9/1987 | Roberts, Jr. |
| 4,718,138 | A | | 1/1988 | Brown et al. |
| 4,720,932 | A | | 1/1988 | Bovino |
| 4,733,897 | A | | 3/1988 | Schuetzeberg |
| 4,761,029 | A | | 8/1988 | Woodcock |
| 4,779,362 | A | | 10/1988 | Citrowske |
| D299,100 | S | | 12/1988 | Martinell et al. |
| 4,790,462 | A | | 12/1988 | Kawaguchi |
| 4,793,496 | A | | 12/1988 | Wait |
| 4,815,642 | A | | 3/1989 | Ray |
| 4,867,359 | A | | 9/1989 | Donovan |
| 4,900,061 | A | | 2/1990 | Kozma, Jr. |
| 4,927,176 | A | | 5/1990 | King et al. |
| 4,942,994 | A | | 7/1990 | Sterenberg |
| D316,620 | S | | 4/1991 | Magor |
| 5,007,185 | A | | 4/1991 | Lazarski |
| 5,042,839 | A | | 8/1991 | Ciari |
| 5,056,820 | A | | 10/1991 | Des Prez |
| 5,147,098 | A | | 9/1992 | McCrink |
| 5,156,418 | A | | 10/1992 | Kelly |
| 5,171,052 | A | | 12/1992 | Cunningham |
| 5,193,694 | A | | 3/1993 | Wave |
| 5,197,760 | A | | 3/1993 | Schollenberger |
| 5,285,939 | A | | 2/1994 | Hogan |
| 5,307,944 | A | | 5/1994 | Reedy |
| 5,358,277 | A | | 10/1994 | Klement, Jr. |
| 5,398,984 | A | | 3/1995 | Elder |
| 5,449,230 | A | | 9/1995 | Murray |
| 5,487,581 | A | | 1/1996 | Carmo et al. |
| 5,524,912 | A | | 6/1996 | Laub et al. |
| 5,599,052 | A | | 2/1997 | Van Davelaar |
| D378,245 | S | | 3/1997 | DeMier |
| 5,697,660 | A | | 12/1997 | Smetz |
| 5,713,097 | A | | 2/1998 | Brown |
| 5,806,691 | A | | 9/1998 | Nelson |
| 5,884,781 | A | | 3/1999 | Ehrhart |
| 5,960,568 | A | | 10/1999 | Bell et al. |
| 6,050,873 | A | | 4/2000 | Reisman |
| 6,247,739 | B1 | | 6/2001 | Lyon |
| 6,273,272 | B1 | | 8/2001 | Hake |
| D453,667 | S | | 2/2002 | Wishnick |
| 6,454,335 | B1 | | 9/2002 | Wishnick |
| 6,827,226 | B2 | | 12/2004 | Coulson |
| 7,290,358 | B2 | | 11/2007 | Francis |
| 2004/0074113 | A1 | | 4/2004 | Kim et al. |
| 2005/0067450 | A1 | | 3/2005 | Trejo et al. |
| 2005/0194803 | A1 | | 9/2005 | Perry |
| 2006/0273128 | A1 | | 12/2006 | Balakier |
| 2007/0051761 | A1 | | 3/2007 | McNeal |
| 2007/0204486 | A1 | | 9/2007 | Fenato |
| 2008/0011694 | A1 | | 1/2008 | Garceau |
| 2008/0079238 | A1 | | 4/2008 | Geisler et al. |
| 2008/0257925 | A1 | | 10/2008 | Brooks |
| 2012/0011746 | A1 | | 1/2012 | Valaas |

OTHER PUBLICATIONS

"Skadi-Innovative Cross Country Skiing Accessories" http://www.skadinordic.com Retrieved from the Internet Aug. 3, 2010.

"Custom Cross Country Ski Ski Ties" http://www.customskitools.com/custom-ski-accessories/custom-cross-country-ski-ties/ Retrieved from the Internet Jan. 17, 2011.

"REI Outdoor Gear, Equipment and Clothing for Winter" http://www.rei.com Retrieved from the Internet Jan. 17, 2011.

"Ski Bones" http://www.skibones.com Retrieved from the Internet Jan. 17, 2011.

http://www.swixracing.us/nordic/products.cat.php?rid=4 2010-2011 Product Catalog, p. 63 Retrieved from the Internet Jan. 17, 2011.

http://www.toko.ch/en/apps/productDetail.html ToKo accessories—Ski Tie Nordic (24 pcs.) Retrieved from the Internet Jan. 13, 2011.

http://www.toko.ch/en/apps/productDetail.html ToKo accessories—Ski Clip Nordic (60 pcs.) Retrieved from the Internet Jan. 13, 2011.

http://www.salomon.com/us/™/nordic/boots Retrieved from the Internet Aug. 3, 2010.

"SkiTraxx—Innovative Cross Country Skiing Accessories" http://www.skitraxx.com Retrieved from the Internet Jul. 15, 2010.

http://www.rei.com Retrieved from the Internet Jul. 28, 2011.

"Ski bones" http://www.skibones.com Retrieved from the Internet Jul. 28, 2011.

International Search Report and Written Opinion of International Search Authority, PCT/US2011/00176, filed Jan. 31, 2011.

"Skiholder Belt/TOKO Wax and Care" http://www.toko.ch/en/products/tools/accessories/skiholder-belt Retrieved from the Internet Feb. 22, 2011.

"Ski & Snowboard Storage Racks" http://www.cozywinters.com/storage Retrieved from the Internet Feb. 22, 2011.

"Amazon.com Indoor Ski Storage" http://www.amazon.com/indoorskistorage Retrieved from the Internet Feb. 22, 2011.

"HE's the Place for Log Furniture, Log Beds, Log Bedding, Cabin Decor" http://www.logfurnitureplace.com/product_info.php? Retrieved from the Internet Feb. 22, 2011.

"Skadi-Innovative Cross Country Skiing Accessories" http://www.skadinordic.com Retrieved from the Internet Jul. 28, 2011.

"Custom Ski Ties at Customskities.com!" http://www.customskities.com Retrieved from the Internet Aug. 1, 2011.

"Ski Straps, Ski Ties; Alpine, Nordic, Custom, Recycled, Podium" http://www.skitie.com Retrieved from the Internet Aug. 1, 2011.

"Swix Velcro Cross Country Ski Straps" http://www.nordicskiersports.com/xc/swix-ski-straps-r0397.html Retrieved from the Internet Aug. 1, 2011.

http://www.alpinasports.com/index/php/nordic-race/category/boots Retrieved from the Internet Aug. 1, 2011.

"Rossignol: Pure mountain company"http://www.rossignol.com/US/US/nordic-men-boots-skating.html Retrieved from the Internet Aug. 1, 2011.

http://www.madshus.com/boots Retrieved from the Internet Aug. 1, 2011.

"Fischer Sports-Nordic Home" http://www.fischersports.com/en/nordic/products/boots/race-classic Retrieved from the Internet Aug. 1, 2011.

* cited by examiner

DEVICE FOR HOLDING A PAIR OF SKIS TOGETHER

BACKGROUND OF THE INVENTION

1. Technical Field

The present invention relates to a reusable, one-piece device for temporarily holding a pair of skis together, with one device in the ski tip area and one at the tail area, so that the skis are easier to transport and store.

2. Background Information

Skiers often use ski straps and the like to tie a pair of skis together until it is time to use them again. Since skis are long (typically about five to seven feet), curved, and slender, carrying them around unbound demands two hands and is difficult to do without bumping into someone or banging the skis. A pair of skis that are temporarily tied together is easier to transport and store. Skis, especially Nordic racing skis, backcountry skis, and other specialty skis, can be quite expensive, and damage to the skis can slow racing times or otherwise interfere with performance, and can possibly be dangerous for the skier and any bystanders.

Unfortunately, current ski holders on the market: 1) tend to slip off the tails of the skis; 2) must be slid so far up the paired skis to work that they compress the curve of the skis; 3) are often so tight that they are difficult to slide over the flared tails of the paired skis; and/or 4) have hook and loop straps which lose their integrity over time. Also, the hook and loop patches may itself scratch, or may attract small particles that scratch, the ski finish. In regard to the second item, using tension to keep ski holders in place damages a pair of skis. Over time, this compression of the skis can lead to a permanent change in the camber of the ski. The camber of a ski, or snowboard, is the slight upward arching curve in the ski or snowboard, usually with the bend in the middle. Each pair of skis is manufactured with a specifically designed camber. Maintaining the intended camber is very important to optimal functioning of the ski.

Optimizing the camber of a ski is only one aspect of the research and work that goes into the design and manufacture of a ski. Skis are designed differently, depending on their intended function, the conditions to which they will likely be exposed, and the attributes (e.g., height, weight, experience level) of the skier. Conditions for consideration include the condition of the snow, its likely dirt content and temperature and moisture content, and the type of snow crystals anticipated. For example, kids' skis are shaped and built differently than backcountry, racing, or recreational skis. It is disappointing to purchase a fine set of skis and find that it has been damaged over time by an inexpensive, poorly designed ski strap or other conventional ski holder that has changed the function of the ski by changing its camber, an important functional attribute of the ski.

In addition, conventional ski holders can be difficult to place on a pair of skis, and they may pop or slide off the skis after a short time. Conventional holders may loosen over time, allowing the skis to slide out of the ski holder. When a pair of skis is properly in a ski holder, the bases face each other, which protects them. An unpaired ski base can more easily be scratched or damaged, which decreases the effectiveness of the ski at sliding on the snow. Also, the movement and weight of a pair of skis in lightweight ski holders as the pair is carried by hand or in a vehicle tends to cause many conventional ski holders to rip, especially along any sewn side seams.

The ski holder device of the present invention is carefully designed not to damage the skis it holds. The present ski holder devices are typically used in pairs. One of the ski holder devices is positioned in the tip end area of a pair of skis positioned base-to-base, and a second one of the ski holder devices is positioned in the tail end area of the pair of skis. The one-piece, inexpensive ski holder device of the present invention can be used for holding a variety of ski types. Also, the present ski holder devices are available in several sizes for use on different types of skis, such as a ski holder device for holding a pair of 42 millimeter wide racing ski, and a wider ski holder device for holding a 48 millimeter wide children's ski, for example.

BRIEF SUMMARY OF THE INVENTION

The present invention is a device for holding two skis together in order to facilitate carrying and storing the pair of skis, base to base, without damaging them. The present ski holder device comprises: (a) two opposite outer longitudinal side walls, each comprising a substantially straight central section; (b) two opposite, substantially straight end walls, an end of each end wall being connected with a corresponding end of one of the longitudinal side walls; (c) an inner longitudinal wall between the outer longitudinal side walls, the inner longitudinal wall being attached at its opposite ends to the opposite end walls, the inner longitudinal wall comprising a substantially straight central section; (d) at least one convolution in each of the outer longitudinal side walls; and at least one convolution in the inner longitudinal wall; and (e) the inner longitudinal wall dividing an interior of the ski holder device into two substantially equal sized, open-ended, ski-receiving channels.

A "straight-walled" ski holder device according to the present invention includes: (a) two opposite, substantially straight outer longitudinal side walls that are substantially parallel to one another; (b) two opposite, substantially straight end walls, an end of each end wall being connected with a corresponding end of one of the longitudinal side walls; (c) an inner longitudinal wall attached at its opposite ends to an inside of the opposite end walls at about a center of the opposite end walls; and (d) the inner longitudinal wall dividing an interior of the ski holder device into two substantially equal sized ski-receiving through channels. The end walls are preferably substantially parallel to one another and substantially perpendicular to each of the outer longitudinal side walls and to the inner longitudinal wall, the inner longitudinal wall being substantially parallel to and between the two outer longitudinal side walls.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
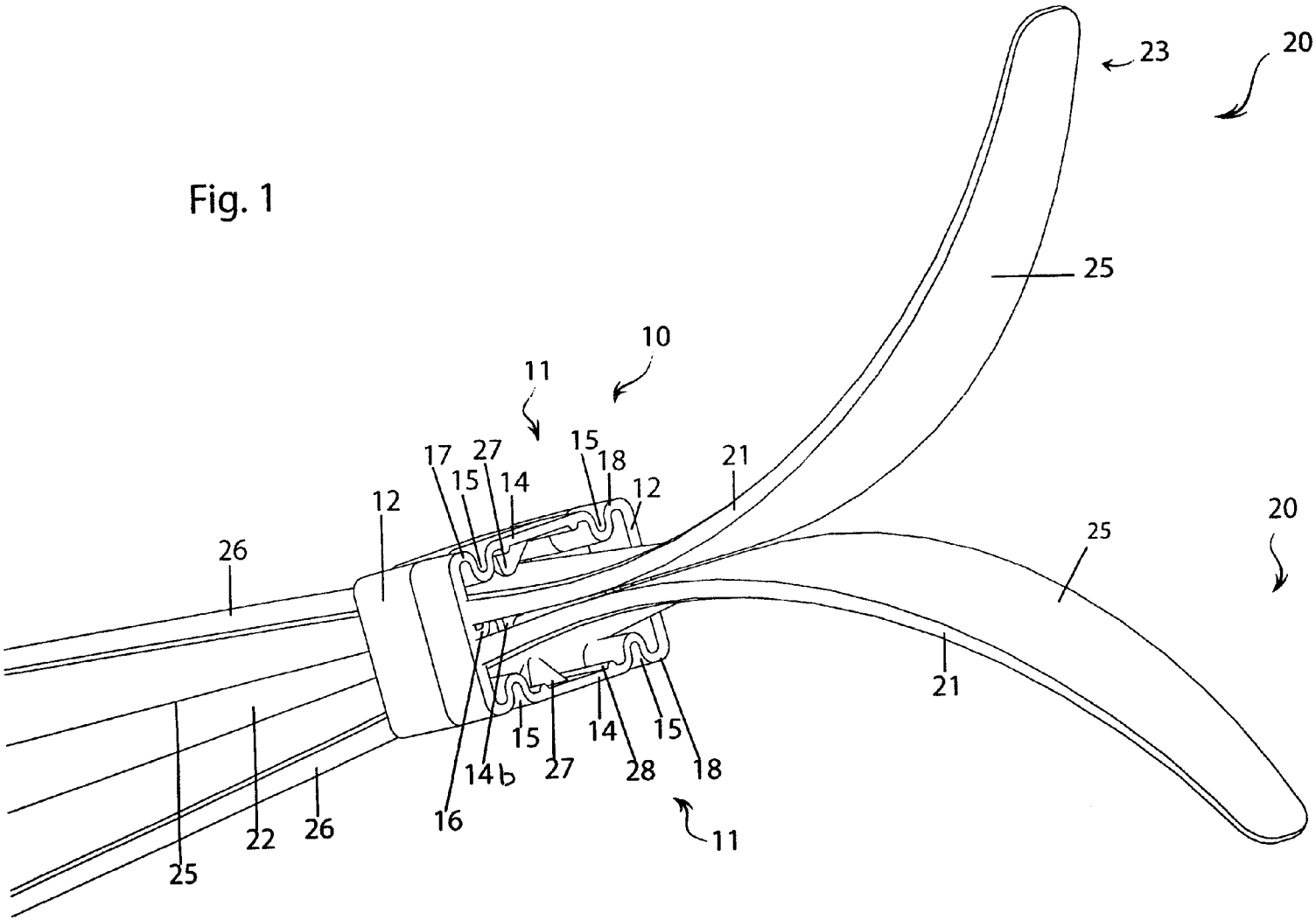
FIG. 1 is a perspective view of a ski holder device according to the present invention, shown holding a pair of skis together.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, a device embodying the principles and concepts of the present invention and generally designated by the reference numeral 10 will now be described.

Figure 2:
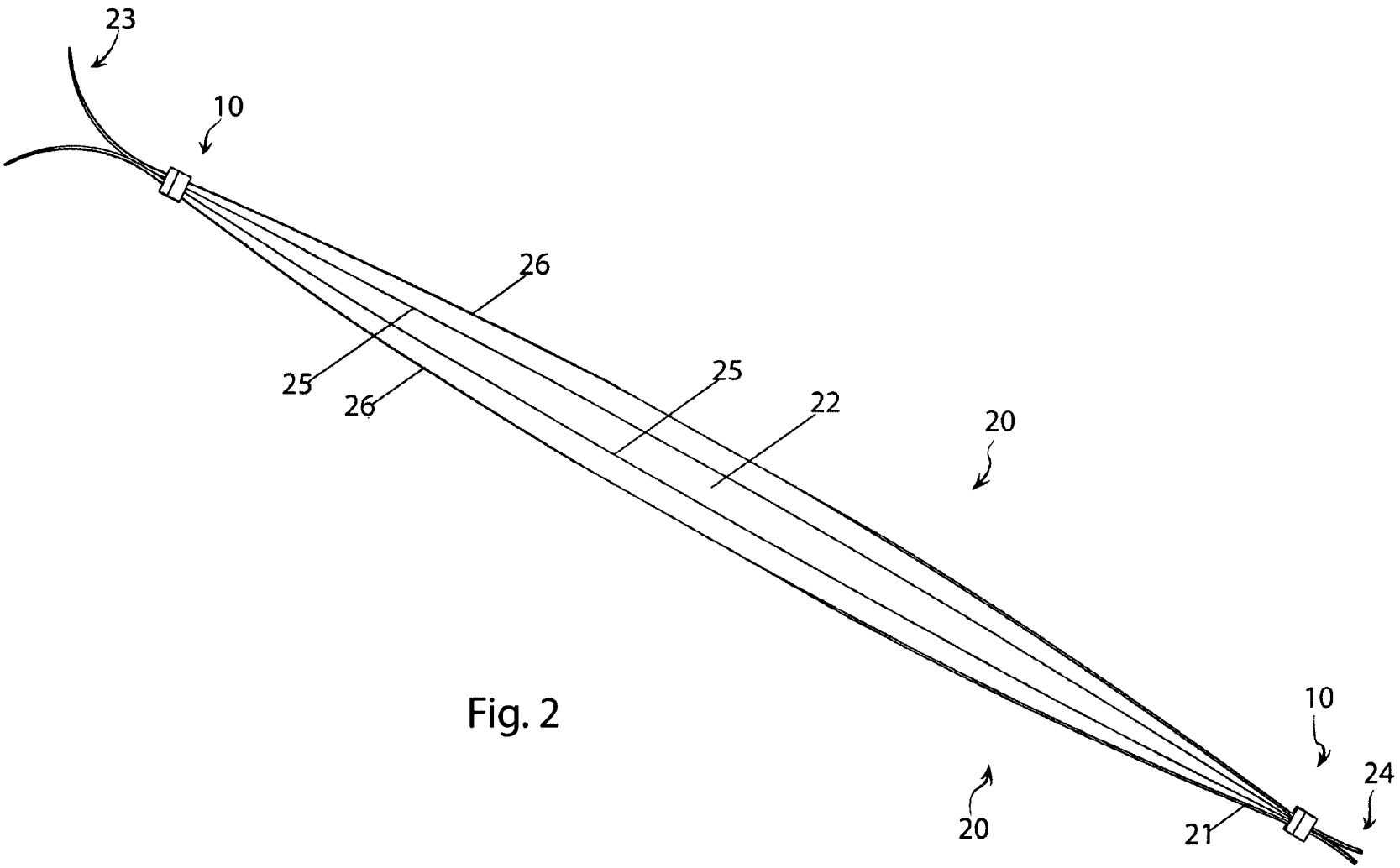
FIG. 2 is a perspective view of two ski holder devices according to the present invention, shown holding a pair of skis together.

As seen in FIGS. 1 and 2, the ski holder device 10 holds two skis 20 together, base to base 25. Two ski holders 10 are preferably used on each set of skis 20: one in the tip end area 23 of the skis and one in the tail end area 24 of the skis 20, as shown in FIG. 2.

Figure 3:
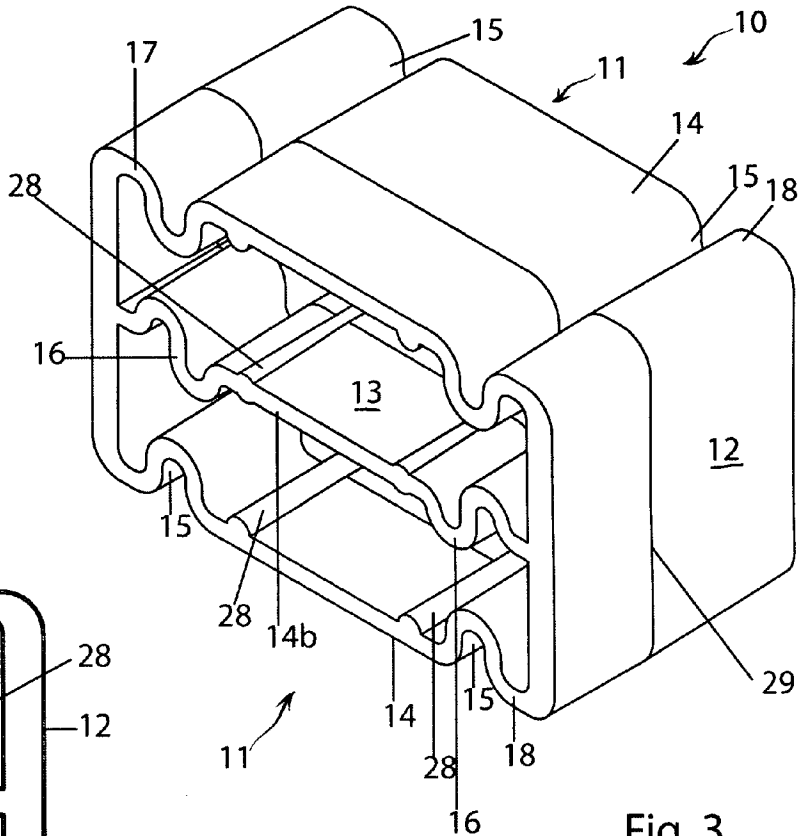
FIG. 3 is a perspective view of a ski holder device according to the present invention.
Figure 4:
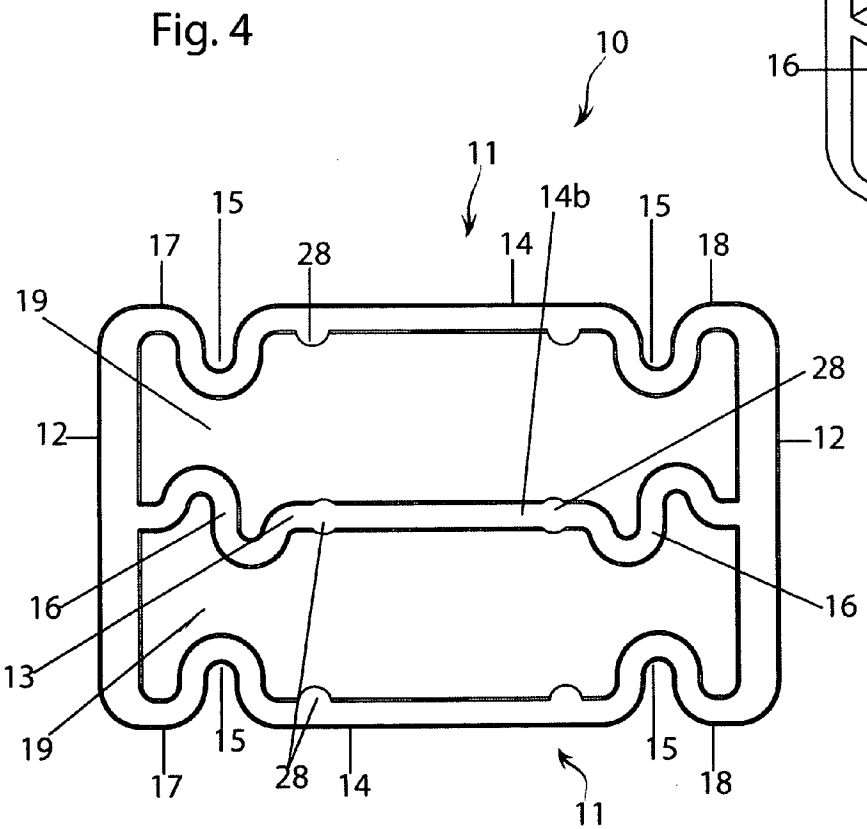
FIG. 4 is a top plan view of the ski holder device of FIG. 3.

As depicted in FIGS. 1 through 6, the one-piece, flexible ski holder device 10 includes: (a) two opposite outer longitudinal side walls 11, each comprising a substantially straight central section 14, the outer longitudinal side walls 11 being substantially parallel to one another; (b) two opposite, substantially straight end walls 12, an end of each end wall 12 being connected with a corresponding end 17/18 of one of the longitudinal side walls 11, the end walls 12 being substantially parallel to one another; (c) an inner longitudinal wall 13 between the outer longitudinal side walls, the inner longitudinal wall being attached at its opposite ends to the opposite end walls 12, the inner longitudinal wall 13 comprising a substantially straight central section 14*b*; (d) at least one convolution 15 in each of the outer longitudinal side walls 11; and at least one convolution 16 in the inner longitudinal wall 13; and (e) the inner longitudinal wall 13 dividing an interior of the ski holder device 10 into two substantially equal sized ski-receiving through channels 19. Preferably, the end walls 12 are substantially perpendicular to each of the outer longitudinal side walls 11 and to the inner longitudinal wall 13, the end walls being same-dimensioned and the outer longitudinal aide walls being same-dimensioned. As is also seen in FIGS. 3 and 4, the opposite ends of the inner longitudinal wall 13 are preferably attached to the inside of the opposite end walls 12 at about the middle of the end walls 12. The convolutions 15 in the outer longitudinal side walls 11 are preferably substantially the same size as one another. The convolutions 15, 16, preferably two, in each longitudinal wall 11, 13 are preferably at opposite ends of the respective central sections 14, 14*b*, which is adjacent an end wall 12.

Each one of the pair of skis 20 extends through one of the two open-ended (through) channels 19 that extend through the ski holder device 10 when the ski holder device 10 is in use. As seen in FIGS. 1 and 3, the one-piece ski holder device 10 is generally block-shaped with an open top and bottom and a through-passage (the channels 19) bordered by the walls 11, 12, 13. It has been found herein that the block-shaped device 10 with its end walls 12 is advantageous over an envelope shape, which is more likely to split at the side seams due to even slight movement of the skis in it. The end walls 12 are continuous with the longitudinal side walls 11 (end wall to outer longitudinal side wall to opposite end wall to opposite outer longitudinal side wall and back to the end wall), so the walls are unlikely to split apart once the skis, which are heavy compared to the device, are in the ski holder device 10. All of the corners of the flexible ski holder device are curved as seen in the figures.

A pair of skis stacked base to base is almost as tall (height being measuring from the top surface 26 of the lower ski 20 to the top surface 26 of the upper ski) as it is wide (ski width being measured from side edge 21 to opposite side edge of a ski). In order to hold the pair of skis 20, the ski holder device 10 has an end wall height (from the top to the bottom of each end wall) of slightly more than, or about the same, as the height of a pair of skis 20 to be held in it (see FIG. 1). The ski holder device 10 preferably has an outer longitudinal side wall length from one end to its opposite end of slightly less than, or equal to, the width of the ski 20 (see FIGS. 1 and 4). The outer longitudinal side wall length is preferably greater than the end wall length of a ski holder device 10. The invention is not limited to these dimensions, though. The height of the ski holder device 10 from top to bottom (i.e., from the top edge to the bottom edge of an outer longitudinal side wall) may vary. The dimensions of the ski holder device, 10 can vary. When there is space between the bases of the skis because of the ski camber, the height from the top surface 26 of the lower ski 20 to the top surface 26 of the upper ski is even greater. The fact that the ski holder device of the present invention is one-piece and has end walls 12 makes it better able to accommodate this distance (height) from the top surface 26 of the lower ski 20 to the top surface 26 of the upper ski.

To place the skis 20 in the ski holder devices 10, an upper channel 19 of the ski holder device 10 is threaded over the tip of an upper one of the skis 20. The corresponding tip of the lower ski 20 is then extended through the lower channel 19 of the same ski holder device 10, with the skis in a base to base position as seen in FIG. 1. A second one of the ski holder devices 10 is then slid over the tails of the skis 20, which are normally not as curved as the ski tips, with the upper ski extending through the upper channel 19 and the lower ski extending through the lower channel 19 of the second ski holder device 10 as seen in FIG. 2. Either of the matching channels 19 in a device 10 can be the upper or the lower, just as either ski can be on top. The first and second ski holder devices 10 are also the same as each other and are interchangeable. The first device 10 in the tip end area 23, and the second device 10 in the tail end area 24 bind the skis 20 to one another without damaging the skis until such time as the ski holder devices 10 are removed.

To remove the ski holder devices 10 from the skis 20, the skier slides the second device 10 off the tails of the skis 20. The skier then pulls one of the skis 20 out of the first device 10, and then slides the first device 10 off the other ski 20.

The camber of a ski is the slight upward arching curve in the ski, usually with the bend in the middle of the ski. The bend, or curve, at the middle of the skis creates a gap 22, or space, between the two skis 20 when they are placed together, as shown in FIG. 2. ("Reverse camber" describes a ski with a slight upward arching curve with a flat rather than curved middle.) Since skis 20 positioned base to base meet at least at their tip ends 23 and tail ends 24 as seen in FIG. 2, the inner longitudinal wall 13 is important for preventing the bases 25 of the skis 20 from banging against, or even contacting, one another. Allowing ski bases 25 to lie against one another could result in damage to the base from the opposite ski.

Continuing with FIGS. 1-4, the central sections 14, 14*b* of the outer and inner longitudinal walls 11, 13 are substantially straight as seen in FIG. 4 so as to accommodate the relatively flat top surfaces 26 and bases 25 of the pair of skis 20 extending through the ski holder device 10. The top and bottom surfaces of the central sections 14, 14*b*, then, are substantially flat. As seen in FIG. 1, each of the inner surfaces of the central sections 14 of the outer longitudinal side walls 11 are adjacent the top surface 26 of one of the skis 20. Each side of the central section 14*b* of the inner longitudinal wall 13 contacts a base 25 of a ski 20. The central sections 14, 14*b* serve the dual purpose of: 1) preventing the ski holder 10 from slipping off the skis 20; and 2) cushioning the skis and preventing them from rubbing or banging against one other. In regard to the first item, the ski holder is prevented from slipping off by friction exerted by the ski holder material against the slick ski top and base surfaces. In regard to the second item, the top surfaces 26 of the skis 20, which lie adjacent the inside of an outer longitudinal side wall 11, are cushioned by the outer longitudinal side walls 11. The inner longitudinal wall 13 keeps the skis 20 separated and prevents the skis from bumping, rubbing, or chafing against one another (including lateral contact) in the area where the ski holder device 10 is. The skis curve up and away from one another (toward the ski tips) in front of the first ski holder 10, and they curve away form one another behind the ski holder device 10 due to the camber in the middle part of the skis. At the rear of the paired skis, the ski tails behind the second ski holder 10 flare slightly apart. In front of the second, rear ski holder 10, the camber in the middle often separates the skis 20 from one another as seen in FIG. 2.

The convolutions 15 at the ends of each outer longitudinal side wall 11 can serve to contain a narrow ski, and help to prevent it from moving around in the ski holder device 10. A C-shaped convolution 15 fits alongside each side edge of the narrow ski 20 to accomplish this benefit. The innermost curves of the S-shaped convolutions 16 at either end of the inner longitudinal wall 13 can accomplish the same goal for a narrow ski.

The convolutions 15 in the outer longitudinal side walls 11 are preferably generally C-shaped as seen in FIGS. 1, 3, and 4. On the outside of each outer longitudinal side wall 11, the convex (open central) part of the "C" faces outward, with the outer curve of the C-shape extending inside the flexible outer longitudinal side wall 11 so that it engages the top surface 26 of the ski 20. The outer curve of each of the C-shaped convolutions 15 extends into (faces) the channel 19 of the ski holder device 10 that is adjacent the outer longitudinal side wall 11 the C-shaped convolution is in.

The convolutions 16 formed in the inner longitudinal wall 13 are preferably generally S-shaped (in transverse cross-section), or serpentine, as seen in FIGS. 3 and 4. The generally S-shaped convolution 16 has one curve that contacts the base 25 of each ski 20 positioned in the ski holder device 10. In the ski holder device 10 shown in FIG. 4, for example, the upper, outermost curves of the S-shaped convolutions 16 contact an upper ski 20 in the ski holder device 10, and the lower, innermost curves of the S-shaped convolutions 16 contact a lower ski in the same ski holder device 10. The S-shapes at either end of the inner longitudinal wall 13 in FIG. 4 are mirror images, so that the upper curves of the two "Ss" cushion the upper ski 20 in the ski holder device 10 and the lower curves of the two "Ss" cushion the lower ski in the ski holder device 10. The convolutions 15, 16 provide effective cushioning for the skis, particularly when compared to the relatively flat pads of some conventional ski holders. The S-shaped convolutions on either end of the central section 14*b* of the inner longitudinal wall 13 are preferably mirror images of one another.

In addition to cushioning the skis 20 in the ski holder device 10, the convolutions 15, 16 allow give in the ski holder device 10, so that in addition to accommodating narrower skis, the ski holder device 10 can stretch out to accommodate somewhat wider skis. Thus, the same ski holder device 10 can be used to hold the skis 20 of different members of a family or team, for example. When the side edges 21 of a wider ski in the ski holder device 10 push against the end walls 12 of the ski holder device 10 from the inside channel 19, the flexible material of the ski holder device 10 allows the device 10 to flex and not rip, thus accommodating the somewhat wider ski. The convolutions 15, 16 act as a spring, allowing the longitudinal walls 11, 13 to elongate to the extent permitted by the convolutions. For very wide skis, though, such as a 48 millimeter wide children's ski, the ski holder device 10 is made in a wider size.

The preferred ski holder device 10 shown in FIGS. 1-6 includes two convolutions 15 in each of the outer longitudinal side walls 11, and two convolutions 16 in the inner longitudinal wall 13. The convolutions 15 in the outer longitudinal side walls 11 are substantially the same size as one another. In the device 10 of FIGS. 1-6, the central section 14 of each outer longitudinal side wall 11 extends between the two convolutions 15 in the respective outer longitudinal side wall. A substantially straight central section 14*b* of the inner longitudinal wall 13 extends between the two convolutions 16 in the inner longitudinal wall. The central section 14*b* of the inner longitudinal wall 13 is preferably substantially parallel to the central sections 14 of the outer longitudinal side walls 11. The three convolutions 15, 16 on each side of the ski holder device 10 are preferably aligned with, or adjacent, one another.

The convolutions 15, 16 may have any suitable shape. A ski holder device 10 may include, for example, S-shaped convolutions 16 in the outer longitudinal side walls 11, and/or C-shaped convolutions 15 in the inner longitudinal wall 13. The convolutions 15, 16 need not be aligned with one another or symmetrical.

The ski holder device 10, 10*b* is made of a flexible material, preferably a polyethylene, a thermoplastic polymer, a natural or synthetic rubber, an elastic material, or any other suitable material. The ski holder devices 10 remain in place: 1) by applying pressure on the sides 21 of the skis 20, thus staying on through tension; and 2) the rubbery ski holder material creates friction between the ski 20 and the ski holder 10, causing the ski holder 10 to remain on the set of skis 20. Other materials are also contemplated for use herein. The material of the device 10 may be coated or sprayed with a chemical or paint, or layered, for example. It is preferably brightly colored for easier location, for example, if it is inadvertently dropped in the snow.

The ski holder device 10 is preferably made from a material having a durometer reading of between about shore A 20 and 100, most preferably about shore A 60. It is believed that as the durometer changes, the coefficient of friction between the ski and the ski holder device changes, as well as the stretchiness of the material. It is also believed that this can change to a large degree without altering the nature and function of the ski holder device 10.

The ski holders 10 of the present invention apply only minimal pressure to the tops of the skis 20, leaving the camber intact. Thus, the present ski holder devices 10 do not interfere with ski structure or performance over repeated uses, or during long storage times, such as the many months of the off-season (e.g., summer). This is in contrast to conventional ski holders that the skier has to slide so far up the skis in order for them to remain in place that the pressure they apply to the tops of the skis causes the camber, or upward curve (see FIG. 2), of the skis to change over time.

The ski holder device 10 is made of a durable, non-porous material capable of engaging the surfaces of the skis. The material is advantageous in that it does not accumulate dirt and transfer it to the skis, or permit water to seep in and cause damage to the ski holder and the skis through repeated freezing and thawing as the temporarily bound skis are exposed to outdoor conditions. The ski holder device 10 will not inadvertently slip off a pair of skis; it must be taken off. The material of the device 10 is soft so that it does not scratch or otherwise damage the ski bases.

When they are not in use, the lightweight ski holder devices 10 can be carried in the skier's pocket, purse, knapsack or the like. If desired, one ski holder device 10 can be compressed slightly and inserted sideways through a channel 19 of the other ski holder device 10 to make them easier to carry. The somewhat adherent material of the ski holder devices 10 keeps them in place until they are separated by the skier for use.

Figure 6:
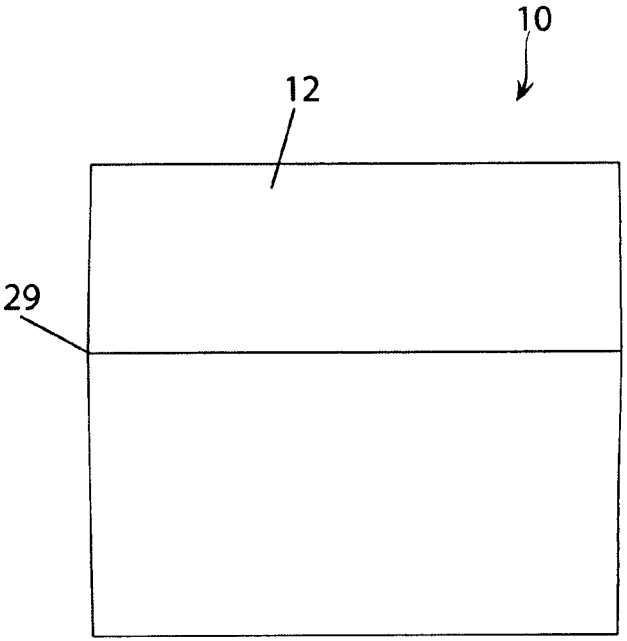
FIG. 6 is an end elevational view of the ski holder device according to FIG. 3.
Figure 5:
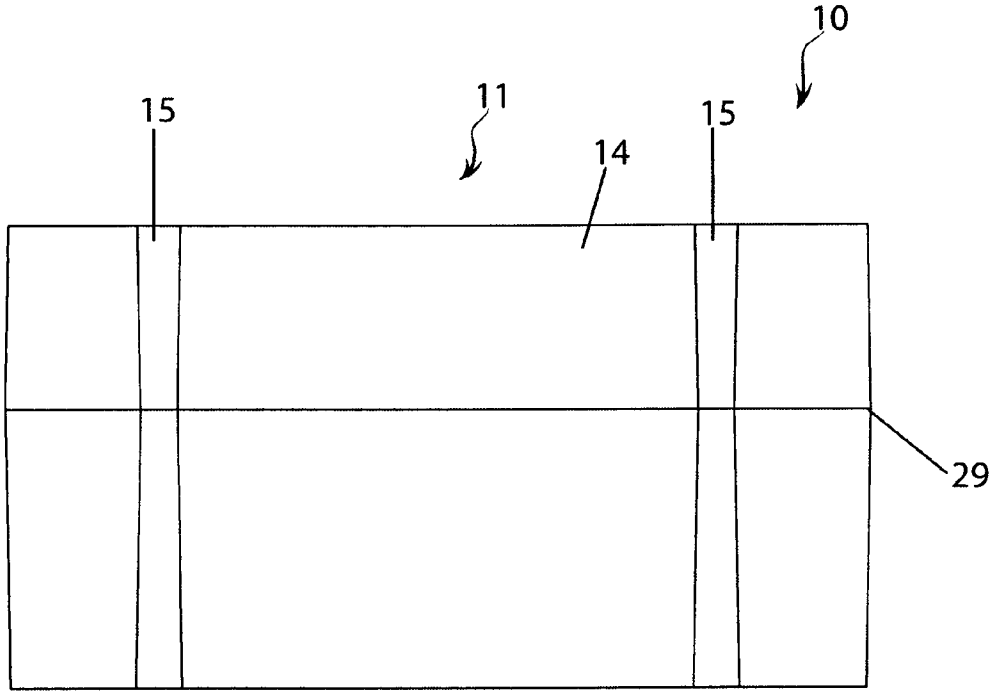
FIG. 5 is a side elevational view of the ski holder device according to FIG. 3.

The one-piece ski holder device 10, including convolutions, is preferably injection molded. As such, it may have a horizontal mold mark 29 that extends around the approximate center of the outside of the outer longitudinal side walls 11 as seen in FIG. 5 and the end walls 12 of the device 10 as seen in FIG. 6. The outer longitudinal side walls 11 have the same construction as one another (FIG. 5). The end walls 12 both have the same construction as one another (FIG. 6). Also, the ski holder device 10 appears virtually the same from the top and bottom, as shown in FIG. 4.

As seen in FIGS. 1 and 3, the ski holder device 10 can optionally include at least one ridge 28 along the inside of the outer longitudinal side wall 11 or along either side of the inner longitudinal wall 13. The ridge 28 extends from the top edge to the bottom edge of the wall 11, 13. The raised ridge 28, which is less curved than a convolution 15, 16, provides additional cushioning for the skis 20. The ski holder device 10 preferably has two matching ridges 28 on the inside of each outer longitudinal side wall 11 and two matching ridges 28 on each side (top surface and bottom surface) of the inner longitudinal wall 13, for total of eight same-sized ridges. A ridge 28 is placed at about the end of each central section 14, 14*b*. The ski holder device 10 preferably includes at least two substantially same-sized ridges 28 on an inside of each of the two outer longitudinal side walls, and at least two same-sized ridges on each side of the inner longitudinal wall 13, each ridge 28 extending from a top edge to a bottom edge of the respective longitudinal wall, with a ridge adjacent each convolution.

Figure 10:
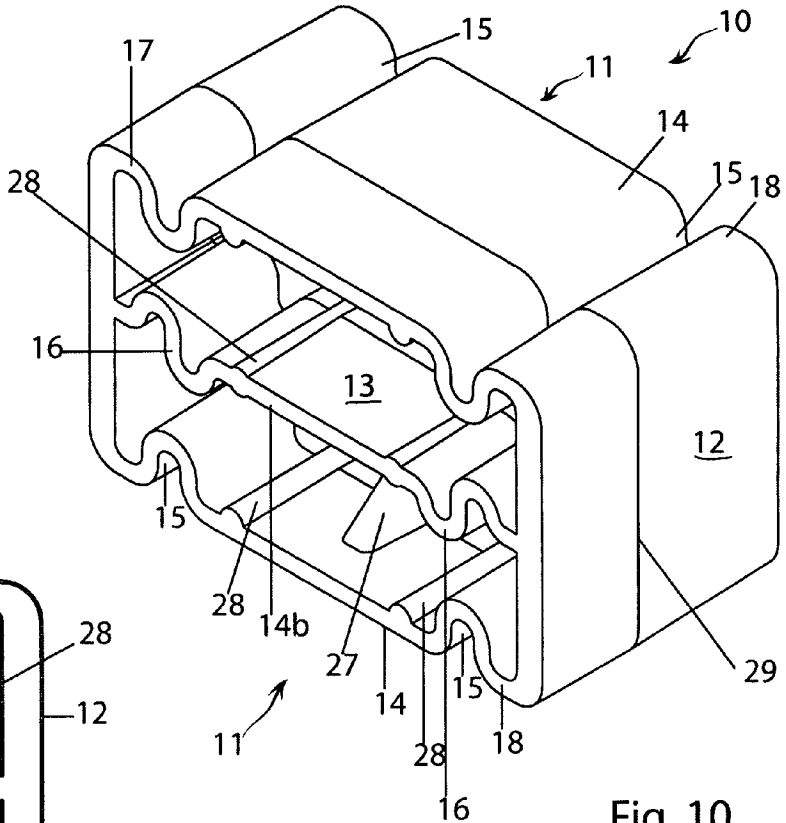
FIG. 10 is a perspective view of a ski holder device according to the present invention.
Figure 11:
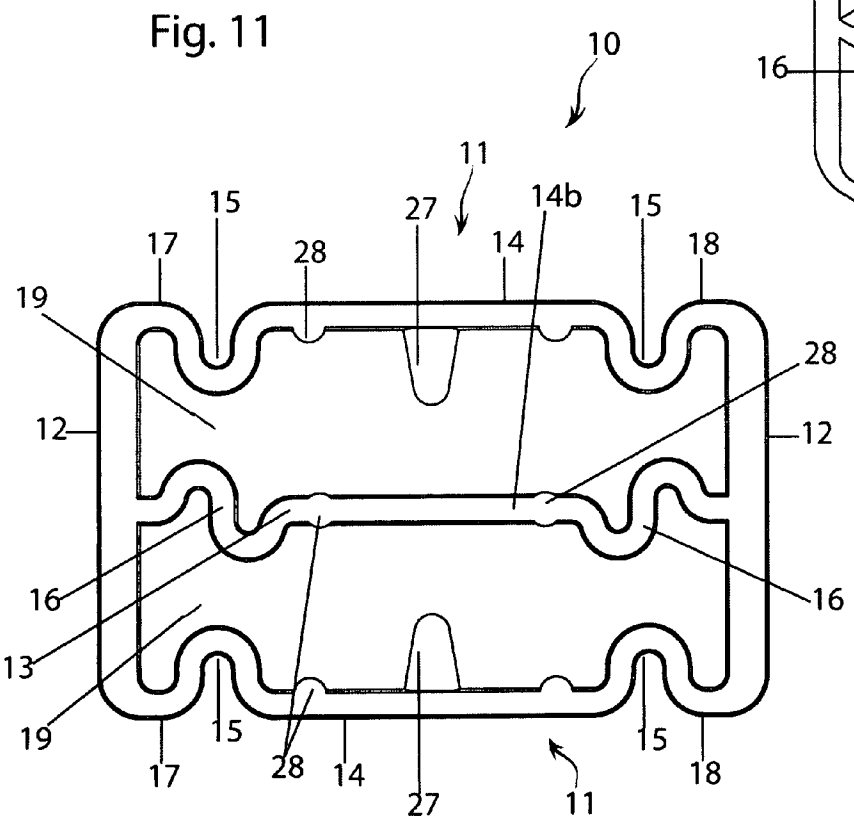
FIG. 11 is a top plan view of the ski holder device of FIG. 9.

In addition to ridges, the ski holder device 10 can optionally include a nose-shaped protrusion 27 seen in FIGS. 10 and 11. A nose-shaped protrusion 27 is formed on the inside of each outer longitudinal side wall 11 at about the middle of the outer longitudinal side wall 11 as shown in FIG. 11. The nose-shaped protrusion 27 also cushions the skis 20. It also compensates for the shallow ski depth (distance from the top surface of the ski to the base) in the ski tip area. The nose-shaped protrusion 27 provides another point of contact with the ski when the ski holder is near the tip of the skis, adding tension and friction. The nose-shaped protrusion 27 adds grip in this shallow ski depth area, helping the ski holder device 10 to remain in place on the paired skis 20. Since the device material is quite flexible, the ski holder device 10 with a nose-shaped protrusion 27 can be used in either the tip area 23 or the tail area 24 of a pair of skis.

Figure 7:
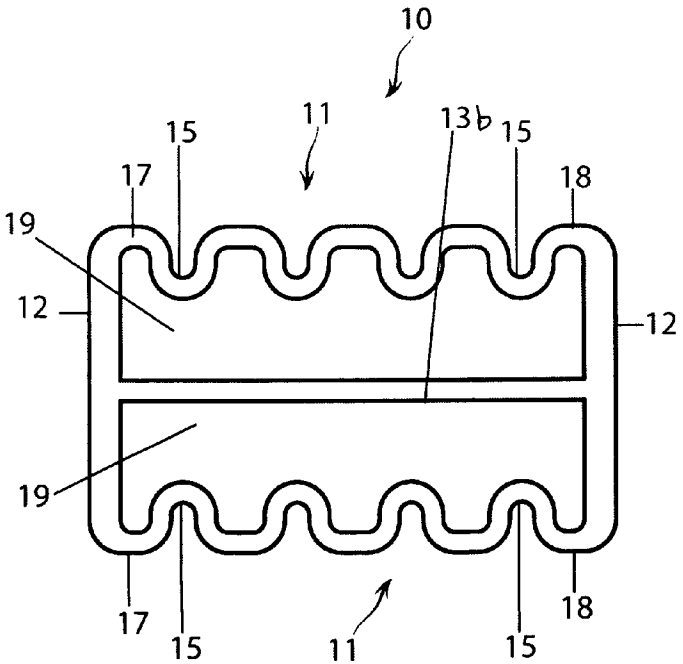
FIG. 7 is a top plan view of a ski holder device according to the present invention.

The ski holder device 10 may include more than two convolutions 15 of any suitable shape in each outer longitudinal side wall 11, and/or in the inner longitudinal wall 13. In the ski holder device 10 of FIG. 7, each longitudinal side wall 11 includes four generally C-shaped convolutions 15. The convolutions 15 cushion the pair of skis 10, help hold the ski holder devices 10 on the pair of skis 20, and permit the ski holder device 10 to stretch out somewhat to accommodate skis of several different widths. The ski holder device 10 may have no convolutions in the inner longitudinal wall 13*b*, as seen in FIG. 7. The substantially straight inner longitudinal wall 13*b* cushions the bases of the skis 20, and provides friction to help keep the ski holder device 10 on the skis 20, as in the device of FIGS. 1-6. The outer longitudinal side walls 11 stretch out to accommodate a slightly wider ski within a certain ski category (e.g., race, backcountry, kids, touring). With slightly wider skis, insertion of the skis 20 in the channels 19 also stretches the flexible inner longitudinal wall 13 out slightly, and the flexible end walls may "hinge out" accordingly.

The ski holder device 10 can conceivably include one or more convolutions in the end walls 12 (not shown), as, for example, where the skier wishes to slide the device 10 further toward the middle of the skis than is shown in FIG. 2. In that case, the end wall convolutions allow the device 10 to expand somewhat to accommodate the increased height from ski top surface 26 to ski top surface 26, which is wider toward the middle of the paired skis because of the ski camber (see FIG. 2).

Figure 8:
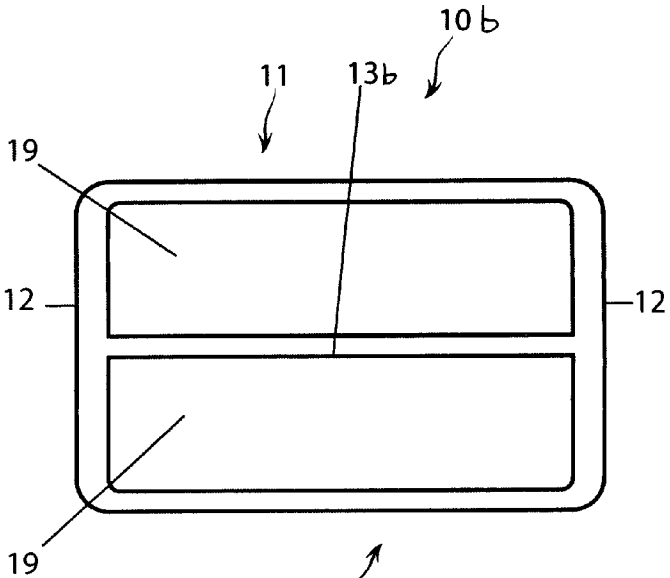
FIG. 8 is a top plan view of a ski holder device according to the present invention.
Figure 9:
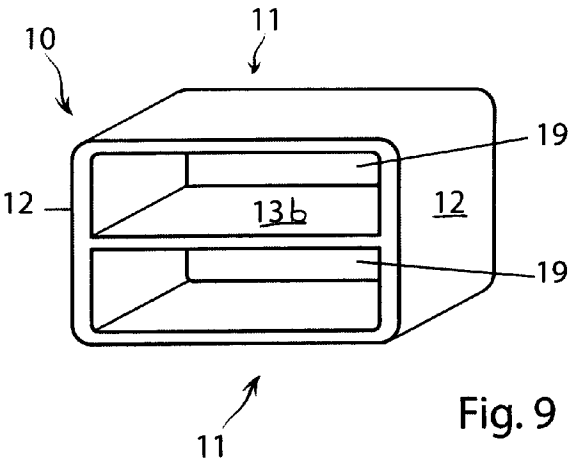
FIG. 9 is a perspective view of the ski holder device according to FIG. 8.

As shown in FIGS. 8 and 9, a "straight-walled" one-piece, flexible ski holder device 10*b* includes: (a) two opposite, same-dimensioned, substantially straight outer longitudinal side walls 11*b* that are substantially parallel to one another; (b) two opposite, same-dimensioned, substantially straight end walls 12, an end of each end wall 12 being connected to a corresponding end 17/18 of one of the longitudinal side walls 11; (c) an inner longitudinal wall 13*b* attached at its opposite ends to an inside of the opposite end walls 12 at about a center of the opposite end walls; and (d) the inner longitudinal wall 13*b* dividing an interior of the ski holder device 10*b* into two substantially equal sized ski-receiving channels 19; wherein the end walls 12 are preferably substantially parallel to one another and substantially perpendicular to each of the outer longitudinal side walls 11 and to the inner longitudinal wall 13, the inner longitudinal wall 13 being substantially parallel to and between the two outer longitudinal side walls 11. The four outer corners on each side of the ski holder device 10 (eight corners in total) are preferably curved as seen in FIG. 9.

The flexible walls 11*b*, 12, 13*b* of the ski holder device 10*b* of FIGS. 8 and 9 serve to: 1) minimize the possibility that the ski holder device 10*b* would slip off the paired skis 20, particularly when the bound pair of skis 20 is propped up in a relatively vertical position; and 2) cushion the skis 20 and prevent them from rubbing or banging against one other. The straight-walled ski holder devices 10*b* are sized to conform to a particular ski genre, such as race, backcountry, children's, and touring. The straight-walled ski holder device 10*b* resembles a miniature bookshelf without a back. The naturally elastic/stretchy material of the "straight-walled" ski holder device 10*b* will accommodate various skis within the genre.

The ski holder device 10*b* preferably includes at least one convolution 15 in the outer longitudinal side wall 11, and/or at least one convolution 16 in the inner longitudinal wall 13, as described herein.

In sum, the present ski holder device 10 has structural end walls 12 for supporting the sides of the pair skis, and is not envelope-shaped. The present device 10 contains no sewn together or glued seams or straps. The present device 10 does not include any sections of hook and loop material to scratch, or to attract small particles that scratch, the ski finish. There are no sewn or glued seams between the end walls 12 and the outer longitudinal side walls 11 in the present ski holder device 10. The end walls 12 are continuous with the outer longitudinal side walls 11; the walls 11, 12 are not seamed to one another and the ski holder device 10 does not open up. The outsides of the end walls 12, and the central sections 14 of the outer longitudinal side walls 11, are preferably substantially planar.

When it is in use, each outer longitudinal side wall 11 of the device 10 extends across the top surface 26 of each ski 20. Any slight pressure is distributed across the outer longitudinal side walls 11 and the end walls 12, rather than pressing intensely down (and up) on the top surfaces of the skis, or squeezing in on the sides of the skis, as do some conventional ski holders, which causes damage to the ski structure.

While the ski holder device 10 does facilitate carrying a pair of skis 20 by keeping them securely paired, it is not itself a ski carrying device. The present ski holder device 10 is not a strap or a clip. The present ski holder device 10 is not easily knocked off the pair of skis. It does not interfere with the clean lines of the skis (by bulging out on the sides of the skis). There are no protrusions from the end walls; the outside of the end walls is substantially smooth. The ski holder device 10 is not made of hard plastic nor are there any parts screwed into it. The ski holder device 10 is separate from the ski and is not permanently mounted on the ski itself. The ski holder device 10 does not include a hinge or a lever.

From the foregoing it can be realized that the described device of the present invention may be easily and conveniently utilized as a ski holder. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 ski holder device
11 outer longitudinal side walls
12 end walls
13 inner longitudinal wall
14 central section (in walls)
15 convolutions in outer longitudinal side walls
16 convolutions in inner longitudinal wall
17 first ends of outer longitudinal side walls,
18 second ends of outer longitudinal side walls
19 channels
20 ski
21 side edge of ski
22 space between skis
23 ski tip area
24 ski tail area
25 base of ski
26 top surface of ski
27 nose-shaped protrusion
28 ridges
29 mold mark

What is claimed is:

1. A one-piece device for holding a pair of skis together base to base, the ski holder device comprising:

(a) two opposite outer longitudinal side walls, each comprising a substantially straight central section;

(b) two opposite, substantially straight end walls, an end of each end wall being connected with a corresponding end of one of the longitudinal side walls;

(c) an inner longitudinal wall between the outer longitudinal side walls, the inner longitudinal wall being attached at its opposite ends to the opposite end walls, the inner longitudinal wall comprising a substantially straight central section;

(d) at least one convolution in each of the outer longitudinal side walls; and at least one convolution in the inner longitudinal wall; and (e) the inner longitudinal wall dividing an interior of the one-piece ski holder device into two substantially equal sized, open-ended, ski-receiving channels, wherein the at least one convolution in each of the outer longitudinal side walls is generally C-shaped, with an outer curve of each of the C-shaped convolutions extending into the channel of the ski holder device that is adjacent that C-shaped convolution.

2. The ski holder device according to claim 1, wherein the outer longitudinal side walls are substantially parallel to one another, the end walls are substantially parallel to one another and substantially perpendicular to each of the outer longitudinal side walls and to the inner longitudinal wall, the opposite ends of the inner longitudinal wall being attached to an inside of the opposite end walls at about a center of each inner longitudinal wall, the end walls being same-dimensioned and the outer longitudinal side walls being same-dimensioned.

3. The ski holder device according to claim 1, wherein there are at least two of the convolutions in each of the outer longitudinal side walls, and at least two of the convolutions in the inner longitudinal wall, the convolutions in the inner longitudinal wall being substantially the same size as one another, and the convolutions in the outer longitudinal side walls being substantially the same size as one another.

4. The ski holder device according to claim 3, wherein the central section of each outer longitudinal side wall extends between two of the at least two convolutions in the respective outer longitudinal side wall.

5. The ski holder device according to claim 4, wherein the substantially straight central section of the inner longitudinal wall extends between two of the at least two convolutions in the inner longitudinal wall, the central section of the inner longitudinal wall being substantially parallel to the central sections of the outer longitudinal side walls.

6. The ski holder device according to claim 3, wherein each of the at least two convolutions in each outer longitudinal side wall is aligned with a corresponding one of the at least two convolutions in the opposite outer longitudinal wall.

7. The ski holder device according to claim 1, wherein the convolutions in the outer longitudinal side walls are generally C-shaped, with an outer curve of each of the C-shaped convolutions in the outer longitudinal side walls extending into the channel of the ski holder device that is adjacent that C-shaped convolution.

8. The ski holder device according to claim 1, further comprising at least one ridge on an inside of each of the two outer longitudinal side walls, each of the ridges extending from a top edge to a bottom edge of each outer longitudinal side wall.

9. The ski holder device according to claim 3, further comprising at least two substantially same-sized ridges on an inside of each of the two outer longitudinal side walls, and at least two same-sized ridges on each side of the inner longitudinal wall, each ridge extending from a top edge to a bottom edge of the respective longitudinal wall, with a ridge adjacent each convolution.

10. The ski holder device according to claim 1, further comprising a nose-shaped protrusion on an inside of each outer longitudinal side wall at about the center of the outer longitudinal side wall.

11. The ski holder device according to claim 6, wherein each of the at least two convolutions in the inner longitudinal wall is aligned with a corresponding one of the at least two convolutions in the outer longitudinal walls.

12. A one-piece device for holding a pair of skis together base to base, the ski holder device comprising: (a) two opposite outer longitudinal side walls, each comprising a substantially straight central section; (b) two opposite, substantially straight end walls, an end of each end wall being connected with a corresponding end of one of the longitudinal side walls; (c) an inner longitudinal wall between the outer longitudinal side walls, the inner longitudinal wall being attached at its opposite ends to the opposite end walls, the inner longitudinal wall comprising a substantially straight central section; (d) at least one convolution in each of the outer longitudinal side walls; and at least one convolution in the inner longitudinal wall; and (e) the inner longitudinal wall dividing an interior of the ski holder device into two substantially equal sized, open-ended, ski-receiving channels; wherein the substantially straight central section of the inner longitudinal wall extends between two of the convolutions in the inner longitudinal wall, the central section of the inner longitudinal wall being substantially parallel to the central sections of the outer longitudinal side walls; and wherein the convolutions in the inner longitudinal wall are substantially the same size as one another, and are generally S-shaped.

13. The ski holder device according to claim 12, wherein there two of the S-shaped convolutions, with one S-shaped convolution on each end of the central section of the inner longitudinal wall, the S-shaped convolutions being mirror images of one another.

14. The ski holder device according to claim 1, wherein the end walls are continuous with the longitudinal side walls, corners of the ski holder device being curved.

15. A one-piece, flexible device for holding a pair of skis together base to base, the ski holder device comprising:

(a) two opposite, substantially straight outer longitudinal side walls that are substantially parallel to one another;

(b) two opposite, substantially straight end walls, an end of each end wall being connected with a corresponding end of one of the longitudinal side walls;

(c) an inner longitudinal wall attached at its opposite ends to an inside of the opposite end walls at about a center of the opposite end walls; and (d) the inner longitudinal wall dividing an interior of the ski holder device into two substantially equal sized ski-receiving through channels; wherein the end walls are preferably substantially parallel to one another and substantially perpendicular to each of the outer longitudinal side walls and to the inner longitudinal wall, the inner longitudinal wall being substantially parallel to and between the two outer longitudinal side walls, and further comprising at least one generally C-shaped convolution in each of the outer longitudinal side walls.

16. The ski holder device according to claim 15, wherein the end walls are about the same dimensions as one another and the outer longitudinal aide walls are about the same dimensions as one another, the end walls being continuous with the longitudinal side walls.

17. The ski holder device according to claim 15, further comprising at least one convolution in the outer longitudinal side wall or at least one convolution in the inner longitudinal wall.

18. The ski holder device according to claim 15, further comprising a plurality of convolutions in the outer longitudinal side walls, the inner longitudinal wall being substantially straight.

19. The ski holder device according to claim 15, comprising between about two and about four of the generally C-shaped convolutions in each of the outer longitudinal side walls, an outer curve of each of the C-shaped convolutions extending into one of the two ski-receiving channels of the ski holder device.

20. The ski holder device according to claim 19, wherein the ski holder device is made from a thermoplastic polymer material having a durometer reading of between about shore A 20 and 100.

* * * * *